US012693071B2

(12) United States Patent
Liu et al.

(10) Patent No.: US 12,693,071 B2
(45) Date of Patent: Jul. 28, 2026

(54) SYSTEM FOR PURIFYING HELIUM GAS, METHOD, AND APPLICATION

(71) Applicants: Changqing Engineering Design Co., Ltd., Xi'an City (CN); China National Petroleum Corporation, Beijing (CN)

(72) Inventors: Zibing Liu, Xi'an City (CN); Peng Qiu, Xi'an City (CN); Zhibo Chang, Xi'an City (CN); Zheng Xia, Xi'an City (CN); Haojie Yu, Xi'an City (CN); Yinchun Liu, Xi'an City (CN); Xuanji Liang, Xi'an City (CN); Denghai Wang, Xi'an City (CN); Feng Liu, Xi'an City (CN); Liang Lin, Xi'an City (CN); Wei Wei, Xi'an City (CN); Junlai Fan, Xi'an City (CN); Yong Ma, Xi'an City (CN); Weiping Jiang, Yulin City (CN); Jie Liu, Inner Mongolia (CN); Yongqiang Guo, Inner Mongolia (CN); Chunjiang Cui, Inner Mongolia (CN); Fuyang Wu, Xi'an City (CN); Zongwei Zhang, Inner Mongolia (CN); Jie Huang, Inner Mongolia (CN)

(73) Assignees: Changqing Engineering Design Co., Ltd., Shaanxi (CN); China National Petroleum Corporation, Beijing (CN)

( * ) Notice: Subject to any disclaimer, the term of this patent is extended or adjusted under 35 U.S.C. 154(b) by 224 days.

(21) Appl. No.: 18/725,202

(22) PCT Filed: Dec. 9, 2022

(86) PCT No.: PCT/CN2022/138123
§ 371 (c)(1),
(2) Date: Jun. 28, 2024

(87) PCT Pub. No.: WO2023/124919
PCT Pub. Date: Jul. 6, 2023

(65) Prior Publication Data

US 2025/0060157 A1 Feb. 20, 2025

(30) Foreign Application Priority Data

Dec. 29, 2021 (CN) ..... 202111642310.X

(51) Int. Cl.
*F25J 3/02* (2006.01)

(52) U.S. Cl.
CPC ..... *F25J 3/029* (2013.01); *F25J 3/0209* (2013.01); *F25J 2200/74* (2013.01); *F25J 2210/60* (2013.01); *F25J 2215/30* (2013.01)

(58) Field of Classification Search
CPC .. F25J 2200/08; F25J 2200/40; F25J 2200/74; F25J 2205/02; F25J 2205/04;
(Continued)

(56) References Cited

U.S. PATENT DOCUMENTS 8,268,050 B2 * 9/2012 Ha ..... F25J 3/067 95/227
2014/0260417 A1 * 9/2014 Herzog ..... F25J 3/0233 62/611

(Continued)

FOREIGN PATENT DOCUMENTS

CN 102564062 A 7/2012
CN 102937369 A 2/2013

(Continued)

OTHER PUBLICATIONS

International Search Report for PCT/CN2022/138123 dated Mar. 4, 2023 (PCT/ISA/210).

*Primary Examiner* — Filip Zec
(74) *Attorney, Agent, or Firm* — Sughrue Mion, PLLC

(57) ABSTRACT

A system for purifying helium gas, a method, and an application. The system includes a first gas-liquid separation
(Continued)

device, a primary helium extraction tower, a second gas-liquid separation device, a secondary helium extraction tower, and a nitrogen removal tower, which are in sequential communication. The first gas-liquid separation device performs first treatment to convert helium-containing natural gas into a first gas and first liquid phases; the primary helium extraction tower performs first distillation on the first gas and first liquid phases to obtain a second gas and second liquid phases; the second gas-liquid separation device performs second treatment to convert the second gas phase to a third gas and third liquid phase; the secondary helium extraction tower performs second distillation on the third gas and third liquid phases to obtain crude helium and a fourth liquid phase form which nitrogen is removed by the nitrogen removal tower.

16 Claims, 1 Drawing Sheet

(58) Field of Classification Search
CPC .. F25J 2210/60; F25J 2215/04; F25J 2215/30; F25J 2270/02; F25J 2270/12; F25J 3/0209; F25J 3/0233; F25J 3/0257; F25J 3/029
See application file for complete search history.

(56) References Cited

U.S. PATENT DOCUMENTS

| | | | | |
|---|---|---|---|---|
| 2018/0209725 | A1* | 7/2018 | Terrien | F25J 3/0257 |
| 2019/0041128 | A1* | 2/2019 | White | F25J 3/08 |
| 2020/0088465 | A1 | 3/2020 | White et al. | |
| 2020/0292230 | A1* | 9/2020 | Anguiano | F25J 3/0219 |
| 2021/0131727 | A1* | 5/2021 | Higginbotham | F25J 3/08 |
| 2023/0392862 | A1* | 12/2023 | Prosser | C01B 23/0036 |

FOREIGN PATENT DOCUMENTS

| | | | |
|---|---|---|---|
| CN | 205939932 | U | 2/2017 |
| CN | 106866339 | A | 6/2017 |
| CN | 109442868 | A | 3/2019 |
| CN | 212747065 | U | 3/2021 |
| CN | 112666373 | A | 4/2021 |
| CN | 113670002 | A | 11/2021 |
| CN | 113686098 | A | 11/2021 |
| RU | 2739748 | C1 | 12/2020 |

* cited by examiner

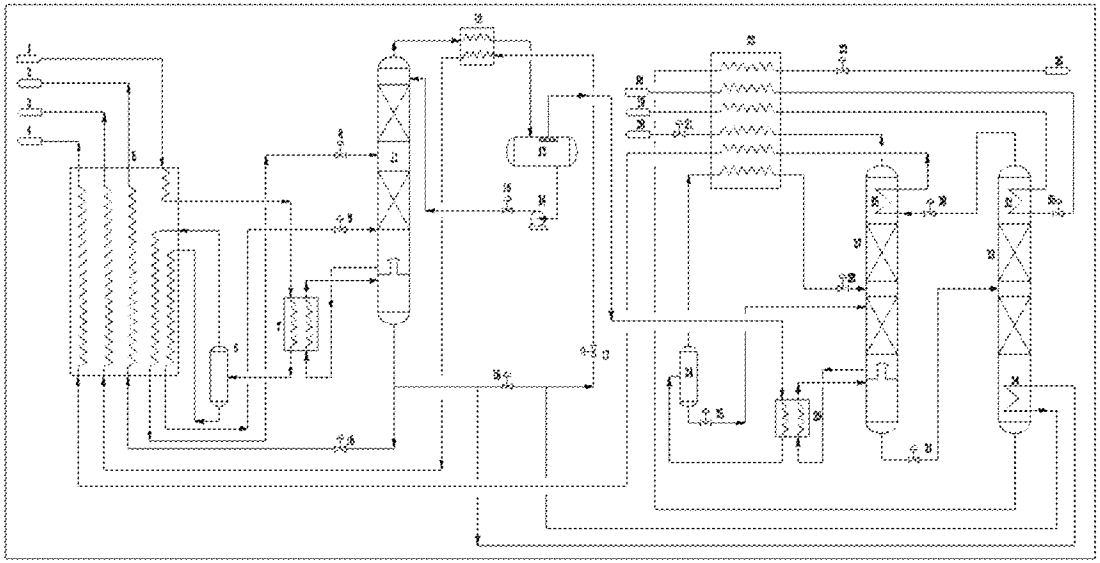

SYSTEM FOR PURIFYING HELIUM GAS, METHOD, AND APPLICATION

CROSS-REFERENCE TO RELATED APPLICATIONS

The application is a National Stage of International Application No. PCT/CN2022/138123 filed Dec. 9, 2022, claiming priority based on Chinese patent application No. "202111642310.X", filed on Dec. 29, 2021, the content of which is specifically and entirely incorporated herein by reference.

TECHNICAL FIELD

The present disclosure relates to the technical field of helium purification, in particular to a system for purifying helium gas, a method and a use thereof.

BACKGROUND ART

Helium gas is a colorless and odorless rare inert gas, it is widely used in clinical medicine, national defense and military industry, aerospace, nuclear industry, deep sea diving, low-temperature superconduction, high-precision welding, and other high-tech fields, thus helium gas is an important, scarce and strategic resource that has a vital association with the national security and the development of the high-tech industries. Helium is a single-atom gas that cannot be synthesized through a chemical reaction, the separation and purification of helium gas from the helium-containing natural gas is currently the only source of industrially produced helium. However, the helium resource in China is deficient, the helium gas product mainly relies on importation. Therefore, the development of a suitable technological process for extracting helium from natural gas has significant and strategic importance for safeguarding the security of the locally used helium in China. In particular, it has positive significance for the comprehensive and efficient use of natural gas resources and improving the economic benefits of the gas field development.

Low-temperature process is the most widely used and mature separation technology in the field of helium extraction from natural gas, it is typically composed of steps such as gas pre-treatment and purification of natural gas, low-temperature distillation for extracting the crude helium, and refining of helium gas.

However, the existing process for extracting helium from natural gas has main defects as follows: (1) the operation of recovering helium components from natural gas adopts a cryogenic process, which requires deep removal of carbon dioxide to ensure that the dry ice is not formed under the low-temperature conditions and avoid the secondary dehydration resulting from the freezing and blocking of cold box and other equipment, the process requires a high capital investment and operating energy consumption, it can hardly achieve economic benefit. (2) the process requires multi-stage co-refrigeration, which has a long technological process, high capital investment, high operating costs, and complex operation, thus the process lacks cost-effectiveness.

Therefore, the pursuit of an economical and efficient process for extracting and purifying helium is still a problem to be urgently solved by the industry.

SUMMARY

The present disclosure aims to overcome the defects in the prior art and provides a system for purifying helium gas, and a method and an application thereof.

In order to achieve the above object, the first aspect of the present disclosure provides a system for purifying helium gas comprising: a first gas-liquid separation device, a primary helium extraction tower, a second gas-liquid separation device, a secondary helium extraction tower, and a nitrogen removal tower which are in sequential communication;

the first gas-liquid separation device is used for performing the first treatment to convert helium-containing natural gas into a first gas phase and a first liquid phase;

the primary helium extraction tower is used for performing the first distillation on the first gas phase and the first liquid phase to obtain a second gas phase and a second liquid phase;

the second gas-liquid separation device is used for performing the second treatment to convert the second gas phase to a third gas phase and a third liquid phase;

the secondary helium extraction tower is used for performing second distillation on the third gas phase and the third liquid phase to obtain crude helium and a fourth liquid phase;

the nitrogen removal tower is used for performing nitrogen removal on the fourth liquid phase to obtain nitrogen gas and Liquefied Natural Gas (LNG) products.

The second aspect of the present disclosure provides a method for purifying helium gas comprising:

(1) performing the first treatment on the helium-containing natural gas to convert it into a first gas phase and a first liquid phase;

(2) performing first distillation on the first gas phase and the first liquid phase to obtain a second gas phase and a second liquid phase;

(3) performing the second treatment on the second gas phase to obtain a third gas phase and a third liquid phase;

(4) performing second distillation on the third gas phase and the third liquid phase to obtain crude helium and a fourth liquid phase;

(5) performing nitrogen removal on the fourth liquid phase to obtain nitrogen gas and LNG product.

The third aspect of the present disclosure provides a use of the system according to the aforementioned first aspect or the method according to the aforementioned second aspect in helium extraction from natural gas.

Due to the above-mentioned technical scheme, the system for purifying helium gas in the present disclosure is provided with a coupling device of a primary helium extraction tower, a secondary helium extraction tower, and a nitrogen removal tower, thereby greatly reducing the cooling power of a refrigerant, significantly lowering the investment amount and saving the operating cost. Wherein the primary helium extraction tower carries out the removal of carbon dioxide (hereinafter referred to as carbon) at low-temperature and the initial concentration of helium gas; the secondary helium extraction tower implements the nitrogen removal at the ultra-low-temperature and the secondary concentration of helium gas; the nitrogen removal tower can produce the ultra-low-temperature nitrogen refrigerant, and provide the secondary helium extraction tower with an overhead cooling source of ultra-low-temperature nitrogen gas, thus the system achieves an efficient extraction of helium gas under the circumstance of without arranging the nitrogen recycling refrigeration system in the conventional process, and the helium recovery rate can reach 99% or more; moreover, the overhead byproduct LNG of the nitrogen removal tower can greatly improve the economic benefits of the overall process.

BRIEF DESCRIPTION OF THE DRAWINGS

The FIGURE illustrates a structural schematic diagram of the system for purifying helium gas according to a specific embodiment of the present disclosure.

The description of reference signs is as follows:

1. Helium-containing natural gas
2. Medium-pressure lean natural gas
3. Low-pressure lean natural gas
4. Export nitrogen gas
5. Primary cold box
6. Primary low-temperature separator
7. Primary tower bottom reboiler
8. First flow regulating valve
9. First liquid level regulating valve
10. Second liquid level regulating valve
11. Primary helium extraction tower
12. Primary helium extraction tower overhead condenser
13. Primary helium extraction tower reflux drum
14. Primary reflux pump
15. Primary helium extraction tower overhead temperature control valve
16. Nitrogen removal tower bottom temperature control valve
17. Third liquid level regulating valve
18. High-pressure refrigerant
19. Low-pressure gaseous phase refrigerant
20. Crude helium product
21. First pressure regulating valve
22. Second cold box
23. Fourth liquid level regulating valve
24. Second low-temperature separator
25. Fifth liquid level regulating valve
26. Secondary helium extraction tower overhead condenser
27. Secondary helium extraction tower
28. Second pressure regulator valve
29. Second tower bottom reboiler
30. Second pressure regulator valve
31. Sixth liquid level regulating valve
32. Nitrogen removal tower overhead condenser
33. Nitrogen removal tower
34. Nitrogen removal tower bottom reboiler
35. LNG product
36. Refrigerant J-T valve

DESCRIPTION OF THE PREFERRED EMBODIMENT

The terminals and any value of the ranges disclosed herein are not limited to the precise ranges or values, such ranges or values shall be comprehended as comprising the values adjacent to the ranges or values. As for numerical ranges, the endpoint values of the various ranges, the endpoint values and the individual point values of the various ranges, and the individual point values may be combined to produce one or more new numerical ranges, which should be deemed to have been specifically disclosed herein.

As illustrated in the FIGURE, the first aspect of the present disclosure provides a system for purifying helium gas comprising: a first gas-liquid separation device, a primary helium extraction tower 11, a second gas-liquid separation device, a secondary helium extraction tower 27, and a nitrogen removal tower 33 which are in sequential communication;

the first gas-liquid separation device is used for performing the first treatment to convert helium-containing natural gas 1 into a first gas phase and a first liquid phase;

the primary helium extraction tower 11 is used for performing the first distillation on the first gas phase and the first liquid phase to obtain a second gas phase and a second liquid phase;

the second gas-liquid separation device is used for performing the second treatment to convert the second gas phase to a third gas phase and a third liquid phase;

the secondary helium extraction tower 27 is used for performing second distillation on the third gas phase and the third liquid phase to obtain crude helium and a fourth liquid phase;

the nitrogen removal tower 33 is used for performing nitrogen removal on the fourth liquid phase to obtain nitrogen gas (export nitrogen gas) and LNG (Liquefied Natural Gas) products.

According to some embodiments of the present disclosure, the first gas-liquid separation device comprises at least one primary cold box 5 and at least one primary low-temperature separator 6.

According to a preferred embodiment of the present disclosure, the first gas-liquid separation device comprises a primary cold box 5 and a primary low-temperature separator 6 which is in sequential communication.

According to some embodiments of the present disclosure, the primary cold box 5 is used for pre-cooling the helium-containing natural gas 1 to obtain a low-temperature helium-containing natural gas; the primary low-temperature separator 6 is used for performing a first low-temperature separation on the low-temperature helium-containing natural gas to obtain a first gas phase and a first liquid phase.

According to some embodiments of the present disclosure, at least one primary tower bottom reboiler 7 is further arranged between the primary cold box 5 and the primary low-temperature separator 6 for cooling the low-temperature helium-containing natural gas, and then feeding it to the primary low-temperature separator 6, such an arrangement mode allows that a portion of $CO_2$ is condensed and precipitated, the first liquid phase enters a higher temperature parts of the middle and lower parts of the primary helium extraction tower 11, effectively suppressing the opportunity for the freezing and blocking by the dry ice of $CO_2$, thereby providing its thermal energy to the primary helium extraction tower 11 as the reboiling heat source while cooling it down.

In the present disclosure, the relative position relationship of the inlet and the outlet for communication between the respective devices are not particularly restricted so long as the requirements of the present disclosure can be satisfied. For example, a gas-phase outlet of the primary low-temperature separator 6 can be connected to the middle part of the primary helium extraction tower 11, and a liquid-phase outlet of the primary low-temperature separator 6 may be connected to the middle and lower parts of the primary helium extraction tower 11.

In the present disclosure, one or more (without limitation on the number of settings) flow-regulating valves, liquid level regulating valves, temperature control valves, and pressure-regulating valves may be arranged between the respective devices.

Preferably, the primary helium extraction tower 11 is connected to the primary tower bottom reboiler 7 for performing a reboiled liquid from the bottom of the primary helium extraction tower 11 to a heat exchange in the primary tower bottom reboiler 7, and feeding the reboiled liquid to a gas-phase space at the bottom of the primary helium extraction tower 11 for supplying heat to the primary helium extraction tower 11.

In the present disclosure, various devices may be connected through pipelines. For example, a primary cold box 5, a primary tower bottom reboiler 7, a primary low-temperature separator 6, a first flow regulating valve 8, a first liquid level regulating valve 9 and a primary helium extraction tower 11 are connected by pipelines.

According to some embodiments of the present disclosure, the second gas-liquid separation device comprises at least one primary helium extraction tower reflux drum 13 and at least one second low-temperature separator 24.

According to some embodiments of the present disclosure, the second gas-liquid separation device comprises a primary helium extraction tower reflux drum 13 and a second low-temperature separator 24 which is in sequential communication.

According to some embodiments of the present disclosure, the primary helium extraction tower reflux drum 13 is used for separating the second gas phase to obtain a gas phase material flow and a liquid phase material flow; the second low-temperature separator 24 is used for performing a second low-temperature separation on the gas phase material flow to obtain a third gas phase and a third liquid phase.

According to some embodiments of the present disclosure, at least one primary helium extraction tower overhead condenser 12 (disposed outside of the primary helium extraction tower) is further arranged between the primary helium extraction tower 11 and the primary helium extraction tower reflux drum 13 for condensing the second gas phase, and then feeding the second gas phase to the primary helium extraction tower reflux drum 13.

According to some embodiments of the present disclosure, at least a second tower bottom reboiler 29 is further arranged between the primary helium extraction tower reflux drum 13 and the second low-temperature separator 24 for cooling the gas phase material flow, and then feeding the gas phase material flow to the second low-temperature separator 24.

According to some embodiments of the present disclosure, a gas-phase outlet of the second low-temperature separator 24 is connected to a middle part of the secondary helium extraction tower 27, and the liquid-phase outlet of the second low-temperature separator 24 is connected to the middle and lower parts of the secondary helium extraction tower 27.

In the present disclosure, a fifth liquid level regulating valve 25 may be further arranged between the second low-temperature separator 24 and the secondary helium extraction tower 27 for controlling the flow rate to the secondary helium extraction tower 27 to be stable.

According to some embodiments of the present disclosure, at least one second cold box 22 is further arranged between the second low-temperature separator 24 and the secondary helium extraction tower 27 for supercooling the third gas phase, and then feeding the third gas phase to the secondary helium extraction tower 27.

In the present disclosure, a second pressure regulator valve 28 may be further arranged between the second cold box 22 and the secondary helium extraction tower 27 for controlling an inlet pressure of the secondary helium extraction tower 27 in a steady state.

According to some embodiments of the present disclosure, a gas-phase outlet of the secondary helium extraction tower 27 is connected to the second cold box 22 for performing a gas phase discharged from the top of said secondary helium extraction tower 27 to a heat exchange via the second cold box 22 to obtain a crude helium product.

In the present disclosure, a first pressure regulating valve 21 may also be arranged at an outlet of the second cold box 22 for controlling the output pressure of the crude helium product.

According to some embodiments of the present disclosure, the secondary helium extraction tower 27 is connected to the second tower bottom reboiler 29 for performing a reboiled liquid in the bottom of the secondary helium extraction tower 27 to a heat exchange in the second tower bottom reboiler 29, and feeding the reboiled liquid to a gas-phase space at the bottom of the secondary helium extraction tower 27 for supplying heat to the secondary helium extraction tower 27.

According to some embodiments of the present disclosure, a nitrogen removal tower overhead condenser 32 is arranged in an upper part of the nitrogen removal tower 33 (i.e. arranged inside the nitrogen removal tower).

According to some embodiments of the present disclosure, the nitrogen removal tower overhead condenser 32 is connected to the second cold box 22 for cooling and liquefying a high-pressure refrigerant 18 in the second cold box 22, and then feeding the high-pressure refrigerant 18 to the nitrogen removal tower overhead condenser 32 for supplying a cooling capacity to the nitrogen removal tower 33 and returning to the second cold box 22 to obtain a low-pressure gaseous phase refrigerant 19.

In the present disclosure, a secondary helium extraction tower overhead condenser 26 is arranged in an upper part of the secondary helium extraction tower 27 (i.e., arranged inside the secondary helium extraction tower) for performing a heat exchange of a gaseous phase (nitrogen gas) at the top of the nitrogen removal tower 33 in the secondary helium extraction tower overhead condenser 26 and supplying a cooling capacity to the secondary helium extraction tower overhead condenser 26, and then recovering the cooling capacity via the secondary cold box 22, and subsequently reheating by a secondary cold box 5, the gaseous phase is discharged from the device as an export nitrogen gas.

According to some embodiments of the present disclosure, a liquid-phase outlet at the bottom of the nitrogen removal tower 33 is connected to the second cold box 22 for supercooling the liquid phase from the bottom of the nitrogen removal tower 33 via the second cold box 22 to obtain a LNG product.

According to some embodiments of the present disclosure, a nitrogen removal tower bottom reboiler 34 is arranged in a lower part of the nitrogen removal tower 33 (i.e. arranged inside the nitrogen removal tower).

According to some embodiments of the present disclosure, the nitrogen removal tower bottom reboiler 34 is connected to the primary helium extraction tower 11 and the primary helium extraction tower overhead condenser 12 for performing a portion of the second liquid phase discharged by the primary helium extraction tower 11 to a heat exchange in the nitrogen removal tower bottom reboiler 34 and supplying heat to the nitrogen removal tower 33, and then feeding the second liquid phase to the primary helium extraction tower overhead condenser 12 for supplying a cooling capacity to the primary helium extraction tower overhead condenser 12 and converting the second liquid phase to a crude natural gas. The use of the specific arrangement (the flow direction of a part of the second liquid phase in the primary helium extraction lower 11) allows for a desirable coupling and utilization of the energies of the various material flows in devices.

In the present disclosure, a nitrogen removal tower bottom temperature control valve may be further arranged between a nitrogen removal tower bottom reboiler 34 and the primary helium extraction tower 11 for controlling nitrogen gas content in the LNG product at the bottom of the nitrogen removal tower.

In the present disclosure, a third liquid level regulating valve 17 may be further arranged between the primary helium extraction tower overhead condenser 12 and the primary helium extraction tower 11 for controlling the flow rate of the reflux.

Preferably, the primary helium extraction tower overhead condenser 12 is connected to the primary cold box 5 for feeding the crude natural gas to the primary cold box 5 for reheating to obtain low-pressure lean natural gas 3.

According to some embodiments of the present disclosure, a liquid-phase outlet of the primary helium extraction tower reflux drum 13 is connected to an upper part of the primary helium extraction tower 11 for feeding the liquid-phase material flow of the primary helium extraction tower reflux drum 13 to the upper part of the primary helium extraction tower 11 as a reflux liquid at the top of the primary helium extraction tower 11.

In the present disclosure, a primary reflux pump 14 and a primary helium extraction tower overhead temperature control valve 15 may be further arranged between the primary helium extraction tower reflux drum 13 and the primary helium extraction tower 11, wherein the primary reflux pump is used for physically pressurizing the liquid phase, the flow rate of said liquid phase is adjusted by the primary helium extraction tower overhead temperature control valve 15, the liquid phase is fed to an upper part of the primary helium extraction tower 11.

According to some embodiments of the present disclosure, the bottom of the primary helium extraction tower 11 is connected to the primary cold box 5 for recovering the cooling capacity of the remainder of the second liquid phase to obtain a medium-pressure lean natural gas 2.

In the present disclosure, a second liquid level regulating valve 10 may be further arranged between the bottom of the primary helium extraction tower 11 and the primary cold box 5 for controlling the liquid level of the remainder of the second liquid phase, and then feeding the second liquid phase to the primary cold box 5 for recovering the cooling capacity.

The second aspect of the present disclosure provides a method for purifying helium gas comprising:

(1) performing the first treatment on the helium-containing natural gas to convert it into a first gas phase and a first liquid phase;

(2) performing first distillation on the first gas phase and the first liquid phase to obtain a second gas phase and a second liquid phase;

(3) performing the second treatment on the second gas phase to obtain a third gas phase and a third liquid phase;

(4) performing second distillation on the third gas phase and the third liquid phase to obtain crude helium and a fourth liquid phase;

(5) performing nitrogen removal on the fourth liquid phase to obtain nitrogen gas and LNG product.

According to some embodiments of the present disclosure, the first treatment in step (1) comprises: pre-cooling the helium-containing natural gas to obtain a low-temperature helium-containing natural gas.

According to some embodiments of the disclosure, the first treatment comprises: performing the helium-containing natural gas and/or the low-temperature helium-containing natural gas to a first low-temperature separation to obtain the first gas phase and the first liquid phase.

According to some embodiments of the present disclosure, the first treatment further comprises: cooling the helium-containing natural gas and/or the low-temperature helium-containing natural gas prior to the first low-temperature separation.

According to some embodiments of the present disclosure, the conditions of the first distillation in step (2) comprise a temperature from −95° C. to −80° C. (e.g., −95° C., −92° C., −90° C., −88° C., −86° C., −85° C., −82° C., −80° C., or any value within the range consisting of two numerical values thereof), and pressure from 3.5 MPa to 4.5 MPa (e.g., 3.5 MPa, 3.8 MPa, 4.0 MPa, 4.2 MPa, 4.4 MPa, 4.5 MPa, or any value within the range consisting of two numerical values thereof). The conditions of the first distillation enable helium gas to undergo a concentration of more than 30 times; $CO_2$ is removed under a low temperature, the whole tower is controlled not to generate dry ice, and the content of $CO_2$ in the second gas phase is less than 50 ppm.

According to some embodiments of the present disclosure, the method further comprises a step of supercooling the first gas phase and the first liquid phase prior to the first distillation.

According to some embodiments of the present disclosure, the method further comprises a step of performing the reboiled liquid obtained from the first distillation to a heat exchange.

According to some embodiments of the present disclosure, the second treatment in step (3) comprises: separating the second gas phase to obtain a gas phase material flow and a liquid phase material flow.

According to some embodiments of the present disclosure, the second treatment comprises performing the second gas phase and/or the gas phase material flow to a second low-temperature separation to obtain a third gas phase and a third liquid phase.

According to some embodiments of the present disclosure, the second treatment further comprises condensing the second gas phase prior to the separation.

According to some embodiments of the present disclosure, the second treatment further comprises cooling the second gas phase and/or the gas phase material flow prior to the second low-temperature separation.

According to some embodiments of the present disclosure, the method further comprises recycling the liquid phase material flow obtained from the separation as a reflux liquid for the first distillation.

According to some embodiments of the present disclosure, the conditions of the second distillation in step (4) comprise a temperature from −185° C. to −110° C. (e.g., −185° C., −180° C., −170° C., −160° C., −150° C., −140° C., −130° C., −120° C., −110° C., or any value within the range consisting of two numerical values thereof) and pressure from 2 MPa to 3 MPa (e.g., 2 MPa, 2.1 MPa, 2.2 MPa, 2.3 MPa, 2.4 MPa, 2.5 MPa, 2.7 MPa, 2.8 MPa, 3 MPa, or any value within the range consisting of two numerical values thereof). The conditions of the second distillation cause the concentrations of methane and nitrogen gas to be significantly reduced, and the helium concentration is further increased.

According to some embodiments of the present disclosure, the method further comprises a step of supercooling the third gas phase prior to the second distillation.

According to some embodiments of the present disclosure, the method further comprises a step of performing the reboiled liquid obtained from the second distillation to a heat exchange.

According to some embodiments of the present disclosure, the method further comprises a step of performing the gas phase obtained from the second distillation to a heat exchange to obtain a crude helium product.

According to some embodiments of the present disclosure, the conditions of the nitrogen removal in step (5) comprise a temperature from −160° C. to −110° C. (e.g., −160° C., −150° C., −140° C., −130° C., −120° C., −110° C., or any value within the range consisting of two numerical values thereof) and pressure from 1.5 MPa to 2.5 MPa (e.g., 1.5 MPa, 1.6 MPa, 1.7 MPa, 1.8 MPa, 2 MPa, 2.2 MPa, 2.5 MPa, or any value within the range consisting of two numerical values thereof). Nitrogen removal is capable of producing both the LNG product and the byproduct nitrogen gas. The nitrogen removal is used such that the byproduct nitrogen gas can provide ultra-low-temperature cooling capacity of −184° C., avoiding the arrangement for a separate nitrogen-cycle refrigeration compressor.

According to some embodiments of the present disclosure, the method further comprises a step of cooling and liquefying the high-pressure refrigerant to obtain a low-pressure gaseous phase refrigerant.

According to some embodiments of the present disclosure, the method further comprises a step of supercooling the liquid phase obtained from the nitrogen removal to obtain an LNG product.

According to some embodiments of the present disclosure, the method further comprises performing a part of the second liquid phase to a heat exchange for converting it to crude natural gas.

According to some embodiments of the present disclosure, the method further comprises reheating the crude natural gas to obtain low-pressure lean natural gas.

According to some embodiments of the present disclosure, the method further comprises recovering the cooling capacity of the remainder of the second liquid phase to obtain medium-pressure lean natural gas.

The specific conditions of the condensation, cooling, heat exchange, separation, low-temperature separation (first low-temperature separation and/or second low-temperature separation), and other steps in the present disclosure are not particularly limited as long as the requirements of the present disclosure can be satisfied, the steps can be carried out with reference to a conventional mode in the art.

The present disclosure does not impose specific limitations on the content of ingredients in the helium-containing natural gas, for example, the helium-containing natural gas comprises the following ingredients in volume fraction: 98-99% of $CH_4$, 0.1-0.5% of $C_2H_6$, 0.2-0.6% of $N_2$, 0.3-0.8% of $CO_2$, 0.01-0.1% of He, and 0.005-0.3% of $H_2$.

According to some embodiments of the present disclosure, the crude helium comprises the following ingredients in volume fraction: 0.2-0.8% of $CH_4$, 6-12% of $N_2$, 60-70% of He, and 15-25% of $H_2$.

The third aspect of the present disclosure provides a use of the system according to the aforementioned first aspect or the method according to the aforementioned second aspect in helium extraction from natural gas.

According to a preferred embodiment and with reference to the FIGURE, the use of the method for purifying helium of the present disclosure in the system for purifying helium of the present disclosure specifically comprises the following steps:

(a) feeding the helium-containing natural gas into a primary cold box 5 for pre-cooling to obtain a low-temperature helium-containing natural gas, and then feeding the obtained low-temperature helium-containing natural gas into a primary tower bottom reboiler 7 for cooling, and further feeding it into a primary low-temperature separator 6 for performing a first low-temperature separation to obtain a first gas phase and a first liquid phase;

(b) feeding the first gas phase and the first liquid phase obtained from step (a) into the primary cold box 5 respectively for supercooling, and then feeding into a primary helium extraction tower 11 and performing a first distillation to obtain a second gas phase and a second liquid phase, wherein the first gas phase is fed into the middle part of the primary helium extraction tower 11, and the first liquid phase is fed into the middle and lower parts of the primary helium extraction tower 11; performing a portion of the second liquid phase discharged by the primary helium extraction tower 11 to a heat exchange in the nitrogen removal tower bottom reboiler 34 and supplying heat to the nitrogen removal tower 33, and then feeding the second liquid phase to the primary helium extraction tower overhead condenser 12 for supplying a cooling capacity to the primary helium extraction tower overhead condenser 12, and converting the second liquid phase to crude natural gas; then feeding the crude natural gas to a primary cold box 5 for preheating to obtain a low-temperature lean natural gas; then recovering the cooling capacity of the remainder of the second liquid phase to obtain a medium-pressure lean natural gas 2; and performing a reboiled liquid in the bottom of the primary helium extraction tower 11 to a heat exchange in the primary tower bottom reboiler 7, and feeding the reboiled liquid to a gas-phase space at the bottom of the primary helium extraction tower 11 for supplying heat to the primary helium extraction tower 11;

(c) feeding the second gas phase obtained in step (b) into a primary helium extraction tower overhead condenser 12 for condensation, and then feeding the second gas phase into a primary helium extraction tower reflux drum 13 for performing a separation to obtain a gas phase material flow and a liquid phase material flow; and feeding the obtained gas phase material flow into a second tower bottom reboiler 29 for cooling and then feeding the cooled gas phase material into a second low-temperature separator 24 for performing a second low-temperature separation to obtain a third gas phase and a third liquid phase; wherein the obtained liquid phase material flow is pressurized by a primary reflux pump 14 and subjected to a temperature regulation by a primary helium extraction tower overhead temperature control valve 15, the liquid phase material flow is fed to the upper part of the primary helium extraction tower 11 as a reflux liquid at the top of the primary helium extraction tower 11;

(d) feeding the third gas phase obtained in step (c) into the second cold box 22 for supercooling, and then feeding it into the middle part of a secondary helium extraction tower 27, feeding the third liquid phase obtained in step (c) into the middle and lower parts of the secondary helium extraction tower 27, performing the third gas phase and the third liquid phase to a second distillation in the secondary helium extraction tower 27 to obtain a gas phase at the top of said tower and a liquid phase (i.e., a fourth liquid phase) at the bottom of said tower, feeding the gas phase from the top of said tower into a second cold box 22 to perform a heat exchange to obtain a crude helium product; performing a reboiled liquid in the bottom of the secondary helium extraction tower 27 to a heat exchange in the second tower bottom reboiler 29, and feeding the reboiled liquid into a gas-phase space at the bottom of the secondary helium extraction tower 27 for supplying heat to the secondary helium extraction tower 27;

(e) performing the fourth liquid phase obtained from step (d) to a nitrogen removal to obtain a gas phase from the top of the tower and a liquid phase from the bottom of the tower; feeding the gas phase from the tower top into a secondary helium extraction tower overhead condenser 32 to perform a heat exchange and supply a cooling capacity for the secondary helium extraction tower overhead condenser 32, then recovering the ultra-low-temperature cooling capacity via a second cold box 22, subsequently reheating by a primary cold box 5 to obtain nitrogen gas (as an export nitrogen gas); feeding the liquid phase from the tower bottom into a secondary cold box 22 for supercooling to obtain a LNG product.

The present disclosure will be described in detail below with reference to examples.

The method for purifying helium gas in the present disclosure was described in the following examples with reference to the FIGURE. Unless otherwise specified, the specific operations in the process were as mentioned above.

EXAMPLE 1

In the example, the helium-containing natural gas comprised the following ingredients: 98.5313% of $CH_4$, 0.2998% of $C_2H_6$, 0.4812% of $N_2$, 0.6311% of $CO_2$, 0.0416% of He, and 0.0150% of $H_2$.

(1) the helium-containing natural gas was fed into a primary cold box for pre-cooling to obtain a low-temperature helium-containing natural gas; the obtained low-temperature helium-containing natural gas was then fed into a primary tower bottom reboiler for cooling, and further fed into a primary low-temperature separator for performing a first low-temperature separation to obtain a first gas phase and a first liquid phase;

(2) the first gas phase and the first liquid phase obtained from step (1) were fed into the primary cold box respectively for supercooling, and then fed into a primary helium extraction tower to perform a first distillation to obtain a second gas phase and a second liquid phase, wherein the first gas phase was fed into the middle part of the primary helium extraction tower, and the first liquid phase was fed into the middle and lower parts of the primary helium extraction tower; wherein the operating conditions of the first distillation were as follows: the temperature of the top of the tower was −94° C., the temperature of the bottom of the tower was −81° C., and the pressure was 4.2 MPa; a portion of the second liquid phase discharged by the primary helium extraction tower was performed to a heat exchange in the nitrogen removal tower bottom reboiler for supplying heat to the nitrogen removal tower, the second liquid phase was then fed to the primary helium extraction tower overhead condenser for supplying a cooling capacity to the primary helium extraction tower overhead condenser, the second liquid phase was converted to crude natural gas; the crude natural gas was then fed into a primary cold box for preheating to obtain a low-temperature lean natural gas; the cooling capacity of the remainder of the second liquid phase was subsequently recovered to obtain a medium-pressure lean natural gas; a reboiled liquid in the bottom of the primary helium extraction tower was performed to a heat exchange in the primary helium extraction tower bottom reboiler, and the reboiled liquid was fed to a gas-phase space at the bottom of the primary helium extraction tower for supplying heat to the primary helium extraction tower;

(3) the second gas phase obtained in step (2) was fed into a primary helium extraction tower overhead condenser for condensation, the second gas phase was then fed into a primary helium extraction tower reflux drum for performing separation to obtain a gas phase material flow and a liquid phase material flow; the obtained gas phase material flow was fed into a second tower bottom reboiler for cooling and then fed into a second low-temperature separator for performing a second low-temperature separation to obtain a third gas phase and a third liquid phase; wherein the obtained liquid phase material flow was pressurized by a primary reflux pump and subjected to a temperature regulation by a primary helium extraction tower overhead temperature control valve, the liquid phase material flow was fed to the upper part of the primary helium extraction tower as a reflux liquid at the top of the primary helium extraction tower;

(4) the third gas phase obtained in step (3) was fed into the second cold box for supercooling, and then fed into the middle part of a secondary helium extraction tower, the third liquid phase obtained in step (3) was fed into the middle and lower parts of the secondary helium extraction tower, the third gas phase and the third liquid phase were performed to a second distillation in the secondary helium extraction tower to obtain a gas phase from the top of the tower and a liquid phase (i.e., a fourth liquid phase) from the bottom of the tower, the gas phase from the top of the tower was fed into a second cold box to perform a heat exchange to obtain a crude helium product; a reboiled liquid in the bottom of the secondary helium extraction tower was performed to a heat exchange in the second tower bottom reboiler, and the reboiled liquid was fed into a gas-phase space at the bottom of the secondary helium extraction tower for supplying heat to the secondary helium extraction tower; wherein the operating conditions of the second distillation were as follows: the temperature of the top of the tower was −181° C., the temperature of the bottom of the tower was −110° C., and the pressure was 2.3 MPa;

(5) the fourth liquid phase obtained from step (4) was performed to a nitrogen removal to obtain a gas phase from the top of the tower and a liquid phase from the bottom of the tower; the gas phase from the tower top was fed into a secondary helium extraction tower overhead condenser to perform a heat exchange and supply a cooling capacity for the secondary helium extraction tower overhead condenser, the ultra-low-temperature cooling capacity was then recovered via a second cold box, the gas phase was subsequently reheated by a primary cold box to obtain nitrogen gas (as an export nitrogen gas); the liquid phase from the tower bottom was fed into a secondary cold box for supercooling to obtain an LNG product; wherein the operating conditions of the nitrogen removal were as follows: the temperature of the top of the tower was −160° C., the temperature of the bottom of the tower was −110° C., the pressure was 1.6 MPa.

Wherein the composition of the crude helium product comprises the following ingredients in volume fraction: 0.6117% of $CH_4$, 10.3476% of $N_2$, 67.7689% of He, and 21.2718% of $H_2$. The recovery rate of helium is 99%.

The above content describes in detail the preferred embodiments of the present disclosure, but the present disclosure is not limited thereto. A variety of simple modifications can be made in regard to the technical solutions of the present disclosure within the scope of the technical concept of the present disclosure, including a combination of individual technical features in any other suitable manner, such simple modifications and combinations thereof shall also be regarded as the content disclosed by the present disclosure, each of them falls into the protection scope of the present disclosure.

The invention claimed is:

1. A system for purifying helium gas comprising: a first gas-liquid separation device, a primary helium extraction tower (11), a second gas-liquid separation device, a secondary helium extraction tower (27), and a nitrogen removal tower (33) which are in sequential communication;

the first gas-liquid separation device is used for performing the first treatment to convert helium-containing natural gas (1) into a first gas phase and a first liquid phase;

the primary helium extraction tower (11) is used for performing the first distillation on the first gas phase and the first liquid phase to obtain a second gas phase and a second liquid phase;

the second gas-liquid separation device is used for performing the second treatment to convert the second gas phase to a third gas phase and a third liquid phase;

the secondary helium extraction tower (27) is used for performing second distillation on the third gas phase and the third liquid phase to obtain crude helium and a fourth liquid phase;

the nitrogen removal tower (33) is used for performing nitrogen removal on the fourth liquid phase to obtain nitrogen gas and LNG products.

2. The system according to claim 1, wherein the first gas-liquid separation device comprises at least one primary cold box (5) and at least one primary low-temperature separator (6);

and/or, the first gas-liquid separation device comprises a primary cold box (5) and a primary low-temperature separator (6) which is in sequential communication;

wherein the primary cold box (5) is used for pre-cooling the helium-containing natural gas (1) to obtain a low-temperature helium-containing natural gas; the primary low-temperature separator (6) is used for performing a first low-temperature separation on the low-temperature helium-containing natural gas to obtain a first gas phase and a first liquid phase;

and/or, at least one primary tower bottom reboiler (7) is further arranged between the primary cold box (5) and the primary low-temperature separator (6) for cooling the low-temperature helium-containing natural gas, and then feeding it to the primary low-temperature separator (6);

and/or, a gas-phase outlet of the primary low-temperature separator (6) is connected to the middle part of the primary helium extraction tower (11), and a liquid-phase outlet of the primary low-temperature separator (6) is connected to the middle and lower parts of the primary helium extraction tower (11);

and/or, the primary helium extraction tower (11) is connected to the primary tower bottom reboiler (7) for performing a reboiled liquid in the bottom of the primary helium extraction tower (11) to a heat exchange in the primary tower bottom reboiler (7), and feeding the reboiled liquid to a gas-phase space at the bottom of the primary helium extraction tower (11) for supplying heat to the primary helium extraction tower (11).

3. The system according to claim 1, wherein the second gas-liquid separation device comprises at least one primary helium extraction tower reflux drum (13) and at least one second low-temperature separator (24);

and/or, the second gas-liquid separation device comprises a primary helium extraction tower reflux drum (13) and a second low-temperature separator (24) which is in sequential communication;

wherein the primary helium extraction tower reflux drum (13) is used for separating the second gas phase to obtain a gas phase material flow and a liquid phase material flow; the second low-temperature separator (24) is used for performing a second low-temperature separation on the gas phase material flow to obtain a third gas phase and a third liquid phase;

and/or, at least one primary helium extraction tower overhead condenser (12) is further arranged between the primary helium extraction tower (11) and the primary helium extraction tower reflux drum (13) for condensing the second gas phase, and then feeding the second gas phase to the primary helium extraction tower reflux drum (13);

and/or, at least a second tower bottom reboiler (29) is further arranged between the primary helium extraction tower reflux drum (13) and the second low-temperature separator (24) for cooling the gas phase material flow, and then feeding the gas phase material flow to the second low-temperature separator (24);

and/or, a gas-phase outlet of the second low-temperature separator (24) is connected to the middle part of the secondary helium extraction tower (27), and the liquid-phase outlet of the second low-temperature separator (24) is connected to the middle and lower parts of the secondary helium extraction tower (27);

and/or, at least one second cold box (22) is further arranged between the second low-temperature separator (24) and the secondary helium extraction tower (27) for supercooling the third gas phase, and then feeding the third gas phase to the secondary helium extraction tower (27);

and/or, a gas-phase outlet of the secondary helium extraction tower (27) is connected to the second cold box (22) for performing a gas phase discharged from the top of said secondary helium extraction tower (27) to a heat exchange via the second cold box (22) to obtain a crude helium product;

and/or, the secondary helium extraction tower (27) is connected to the second tower bottom reboiler (29) for performing a reboiled liquid in the bottom of the secondary helium extraction tower (27) to a heat exchange in the second tower bottom reboiler (29), and feeding the reboiled liquid to a gas-phase space at the bottom of the secondary helium extraction tower (27) for supplying heat to the secondary helium extraction tower (27).

4. The system according to claim 3, wherein a nitrogen removal tower overhead condenser (32) is arranged in an upper part of the nitrogen removal tower (33);

and/or, the nitrogen removal tower overhead condenser (32) is connected to the second cold box (22) for cooling and liquefying a high-pressure refrigerant (18) in the second cold box (22), and then feeding the high-pressure refrigerant (18) to the nitrogen removal tower overhead condenser (32) for supplying a cooling capacity to the nitrogen removal tower (33) and returning to the second cold box (22) to obtain a low-pressure gaseous phase refrigerant (19);

and/or, a liquid-phase outlet at the bottom of the nitrogen removal tower (33) is connected to the second cold box (22) for supercooling the liquid phase from the bottom of the nitrogen removal tower (33) via the second cold box (22) to obtain an LNG product.

5. The system according to claim 3, wherein a nitrogen removal tower bottom reboiler (34) is arranged in a lower part of the nitrogen removal tower (33);

and/or, the nitrogen removal tower bottom reboiler (34) is connected to the primary helium extraction tower (11) and the primary helium extraction tower overhead condenser (12) for performing a portion of the second liquid phase discharged by the primary helium extraction tower (11) to a heat exchange in the nitrogen removal tower bottom reboiler (34) and supplying heat to the nitrogen removal tower (33), and then feeding the second liquid phase to the primary helium extraction tower overhead condenser (12) for supplying a cooling capacity to the primary helium extraction tower overhead condenser (12), and converting the second liquid phase to a crude natural gas;

and/or, the primary helium extraction tower overhead condenser (12) is connected to the primary cold box (5) for feeding the crude natural gas to the primary cold box (5) for reheating to obtain low-pressure lean natural gas (3).

6. The system according to claim 3, wherein a liquid-phase outlet of the primary helium extraction tower reflux drum (13) is connected to an upper part of the primary helium extraction tower (11) for feeding the liquid phase material flow of the primary helium extraction tower reflux drum (13) to the upper part of the primary helium extraction tower (11) as a reflux liquid at the top of the primary helium extraction tower (11).

7. The system according to claim 1, wherein the bottom of the primary helium extraction tower (11) is connected to the primary cold box (5) for recovering the cooling capacity of the remainder of the second liquid phase to obtain a medium-pressure lean natural gas (2).

8. A method for extracting helium from natural gas employing the system according to claim 1.

9. A method for purifying helium gas comprising the following steps:

(1) performing the first treatment on the helium-containing natural gas to convert it into a first gas phase and a first liquid phase;

(2) performing first distillation on the first gas phase and the first liquid phase to obtain a second gas phase and a second liquid phase;

(3) performing the second treatment on the second gas phase to obtain a third gas phase and a third liquid phase;

(4) performing second distillation on the third gas phase and the third liquid phase to obtain crude helium and a fourth liquid phase;

(5) performing nitrogen removal on the fourth liquid phase to obtain nitrogen gas and LNG product.

10. The method according to claim 9, wherein the first treatment in step (1) comprises: pre-cooling the helium-containing natural gas to obtain a low-temperature helium-containing natural gas;

and/or the first treatment comprises: performing the helium-containing natural gas and/or the low-temperature helium-containing natural gas to a first low-temperature separation to obtain the first gas phase and the first liquid phase;

and/or, the first treatment further comprises: cooling the helium-containing natural gas and/or the low-temperature helium-containing natural gas prior to the first low-temperature separation.

11. The method according to claim 9, wherein the conditions of the first distillation in step (2) comprise a temperature from −95° C. to −80° C. and a pressure from 3.5 MPa to 4.5 MPa;

and/or, the method further comprises a step of supercooling the first gas phase and the first liquid phase prior to the first distillation;

and/or, the method further comprises a step of performing the reboiled liquid obtained from the first distillation to a heat exchange.

12. The method according to claim 9, wherein the second treatment in step (3) comprises: separating the second gas phase to obtain a gas phase material flow and a liquid phase material flow;

and/or the second treatment comprises performing the second gas phase and/or the gas phase material flow to a second low-temperature separation to obtain a third gas phase and a third liquid phase;

and/or, the second treatment further comprises condensing the second gas phase prior to the separation;

and/or, the second treatment further comprises cooling the second gas phase and/or the gas phase material flow prior to the second low-temperature separation;

and/or, the method further comprises recycling the liquid phase material flow obtained from the separation as a reflux liquid for the first distillation.

13. The method according to claim 9, wherein the conditions of the second distillation in step (4) comprise a temperature from −185° C. to −110° C. and a pressure from 2 MPa to 3 MPa;

and/or the method further comprises a step of supercooling the third gas phase prior to the second distillation;

and/or, the method further comprises a step of performing the reboiled liquid obtained from the second distillation to a heat exchange;

and/or, the method further comprises a step of performing the gas phase obtained from the second distillation to a heat exchange to obtain a crude helium product.

14. The method according to claim 9, wherein the conditions of the nitrogen removal in step (5) comprise a temperature from −160° C. to −110° C. and pressure from 1.5 MPa to 2.5 MPa;

and/or, the method further comprises a step of cooling and liquefying the high-pressure refrigerant to obtain a low-pressure gaseous phase refrigerant;

and/or, the method further comprises a step of supercooling the liquid phase obtained from the nitrogen removal to obtain LNG product;

and/or the method further comprises performing a part of the second liquid phase to a heat exchange for converting it to crude natural gas;

and/or, the method further comprises reheating the crude natural gas to obtain low-pressure lean natural gas;

and/or the method further comprises recovering the cooling capacity of the remainder of the second liquid phase to obtain medium-pressure lean natural gas.

15. The method according to claim 9, wherein the helium-containing natural gas comprises the following ingredients in volume fraction: 98-99% of $CH_4$, 0.1-0.5% of $C_2H_6$, 0.2-0.6% of $N_2$, 0.3-0.8% of $CO_2$, 0.01-0.1% of He, and 0.005-0.3% of $H_2$;

and/or, the crude helium comprises the following ingredients in volume fraction: 0.2-0.8% of $CH_4$, 6-12% of $N_2$, 60-70% of He, and 15-25% of $H_2$.

16. A method for extracting helium from natural gas employing the method according to claim 9.

* * * * *